United States Patent [19]

Viehe

[11] 4,377,412

[45] * Mar. 22, 1983

[54] IMPROVED ROTARY SCRAPER HAVING FLEXIBLE FINGERS

[76] Inventor: John S. Viehe, 692 Talamini Rd., Bridgewater, N.J. 08807

[ * ] Notice: The portion of the term of this patent subsequent to Apr. 13, 1999, has been disclaimed.

[21] Appl. No.: 281,096

[22] Filed: Jul. 7, 1981

Related U.S. Application Data

[63] Continuation-in-part of Ser. No. 187,714, Sep. 16, 1980, Pat. No. 4,324,017.

[51] Int. Cl.[3] ..... A47L 13/08

[52] U.S. Cl. ..... 15/236 C; 15/198; 29/816

[58] Field of Search ..... 15/179, 197, 198, 236 C; 29/816

[56] References Cited

U.S. PATENT DOCUMENTS

| | | | |
|---|---|---|---|
| 188,132 | 3/1877 | Haskins | 15/198 |
| 1,475,074 | 11/1923 | McLaughlin | 15/179 |
| 1,583,587 | 5/1926 | Flynn | 15/198 X |
| 3,958,294 | 5/1976 | Thompson | 15/198 |
| 4,106,193 | 8/1978 | Fisher et al. | 15/236 X |
| 4,183,113 | 1/1980 | Fusco | 15/236 C |
| 4,200,947 | 5/1980 | Ali | 15/198 |
| 4,229,912 | 10/1980 | Laughlin | 15/198 X |

*Primary Examiner*—Chris K. Moore
*Attorney, Agent, or Firm*—Jacob B. Burke

[57] ABSTRACT

A rotary scraper device for treating a work surface, comprises a generally cylindrical hollow hub casing having a peripheral wall. The hub casing has a closed end wall and open opposite end with a cover plate removably mounted on the open end of the hub casing, and a shaft extending axially outward of the cover plate for rotating the hub casing axially in one direction. Spaced walls inside the hub define chordal channels opening at the peripheral wall. The channels terminate at axially disposed sleeves inside the hub casing. Springy U-shaped clips have cylindrical bights fitted in the sleeves and springy side walls abutting spaced walls of the channels. Springy ends of the clips extend outwardly beyond the peripheral wall of the hub casing. Straight springy shanks of the fingers fit turnably in coplanar array inside the clips axially of the hub casing. Knuckles at ends of the fingers fit in the cylindrical bights axially of the hub casing. The springy shanks of the fingers extend outwardly beyond the springy side walls of the clips. The outer ends of the clip walls support the springy shanks when they are flexed. The hub can be axially shorter than one half inch so that the springy fingers can scrape narrow surfaces and can enter narrow corners and crevices.

12 Claims, 14 Drawing Figures

IMPROVED ROTARY SCRAPER HAVING FLEXIBLE FINGERS

This application is a continuation-in-part of my copending U.S. patent application entitled "Rotary Device For Treating Work Surfaces", Ser. No. 187,714, filed Sept. 16, 1980 now U.S. Pat. No. 4,324,017, issued Apr. 13, 1982. This invention concerns improvements in the rotary scraper device described in my prior application.

In my prior application, I disclosed a versatile, heavy duty, rotary scraper adapted by use of interchangeable springy fingers to perform a variety of scraping functions. The scraper includes a hollow hub or casing having a closed end wall and open opposite end closed by a removable cover plate to serve as a hub of the scraper device. The hub casing is formed with a plurality of circumferentially spaced channels tangential to and communicating with internal cylindrical sleeves axially oriented in the hub. The channels are chordally disposed in the hub. A plurality of springy fingers can be fitted into each of the channels in side-by-side disposition to extend from the hub casing in coplanar array chordally to the casing. The fingers have cylindrical or round inner ends or knuckles which fit into the cylindrical sleeves in the casing. The knuckles are tangential to straight springy shanks of the fingers. The adjacent opposing side walls of the channels are curved at their outer ends to provide support for the springy elements both when they are flexed to apply scraping force to a work surface and when they snap back or rebound and oscillate on turning free from the work surface. Since the channels in the hub casing are oriented chordally, the straight springy fingers extend outwardly of the casing chordally to the casing to scrape a work surface while the casing rotates. Blunt leading edges of wedge shaped formations of the casing walls allow the springy shanks of the fingers to snap forwardly and oscillate after leaving the work surface without bearing on sharp channel corners. Curved trailing sections of the channel walls support the springy fingers at points of maximum stress and flexure when the fingers are bent backwardly while bearing on the work surface. The hub casing is formed with an integral, continuous serpentine peripheral wall defining the several channels and the cylindrical sleeves. This wall has outer cylindrical wall sections adjacent to outer curved finger supporting wall sections which merge into flat inside guide wall or channel sections which terminate in the inner cylindrical sleeves. The sleeves engage the tangential knuckles of the springy fingers. The knuckles and straight springy shanks are loosely fitted in the cylindrical sleeves and channel respectively. This permits the fingers and knuckles to turn angularly slightly so that the fingers can bear against the trailing and leading wall surfaces of the channel walls in turn during use. The loose fit of the fingers also facilitates their easy removal and replacement when worn or for performing different functions.

It has been found desirable to lengthen the useful working lives of the flexible fingers which sometimes break due to metal fatigue after extended heavy duty use. According to the present invention, this result has been accomplished by providing special spring clips which are inserted into several channels and sleeves in the hub casing. Each clip has a modified U-shape, with one longer side wall and a shorter side wall both integral with a cylindrically curved bight or loop at the apex of the clip. A rather sharp bend is formed at the inner end of the longer side wall where it joins the apical loop, to bear against an angular corner at the inner end of each hub channel at the trailing side where it opens into the inner sleeve.

While treating a work surface the springy fingers and the trailing longer side wall of the clip flex against the rounded trailing surface at the outer end of a hub channel. When the springy fingers are released from the work surface as the hub rotates, these fingers and the adjacent leading short side wall of the clip flex against the blunt end of the leading wedge shaped formation at the outer end of the channel. The walls of the clips flex alternately in turn and thus back up and reinforce the rapidly flexed flexible fingers. By this construction, the bending force of each finger under stress is distributed along a radially longer surface than is provided by the trailing rounded sections of the channel walls and by the leading wedge shaped formations, all of which have smaller radii of curvature than the stressed, springy side walls of the spring clips.

Another improvement provided by the present invention over the prior scraper described above, for certain applications, is an axially shorter hub casing with chordal channels to hold an axially shorter array of springy fingers. This construction makes it possible to scrape narrow welds without touching adjacent surfaces. Further, by modifications of ends of the flexible fingers to chisel-shaped, angular or V-shaped formations, it also becomes possible to use the device for scraping surfaces in sharp corners and narrow, angular and V-shaped crevices.

The springy clips described will be used in all scrapers both those axially longer and shorter, to lengthen the useful lives of the springy fingers.

The above and other advantages and objects of the invention will be better understood from the following detailed description taken together with the drawings wherein.

In the following detailed description, identical numerals represent corresponding identical parts.

Figure 1:
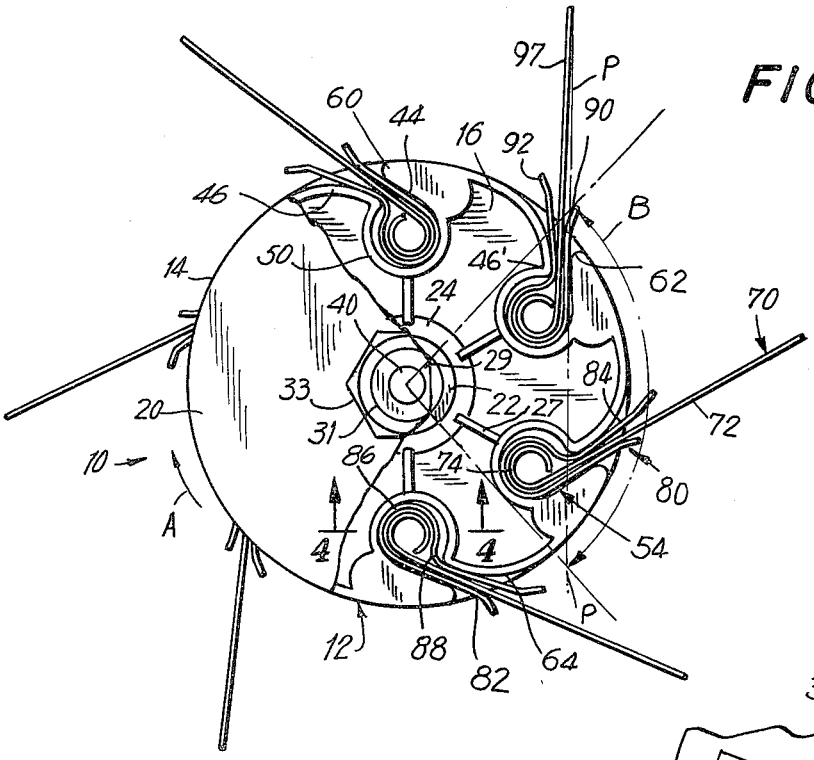
FIG. 1 is an end view of an assembled rotary scraper embodying the invention, part of an end cover plate being broken away to show internal construction.

Referring now to the drawings, there is shown in FIGS. 1–4, a rotary scraper 10 having a cylindrical hub body or casing 12. The hub has an external generally cylindrical peripheral wall 14, an integral circular end wall 16, and an open end 18. A circular removable cover plate 20 closes the open end 18. Plate 20 has a central hole 21. Integral with closed end wall 16 is an axial cylindrical sleeve 22 whose axial length is equal to the internal axial length of hub 12. Sleeve 22 has a conical end portion 24 integral at its wider end with wall 16. Chordal flat lands 26 are formed in conical sleeve portion 24; see FIGS. 1 and 2. Internal short radial ribs 27 reinforce wall 16 at sleeve end portion 24.

Figure 4:
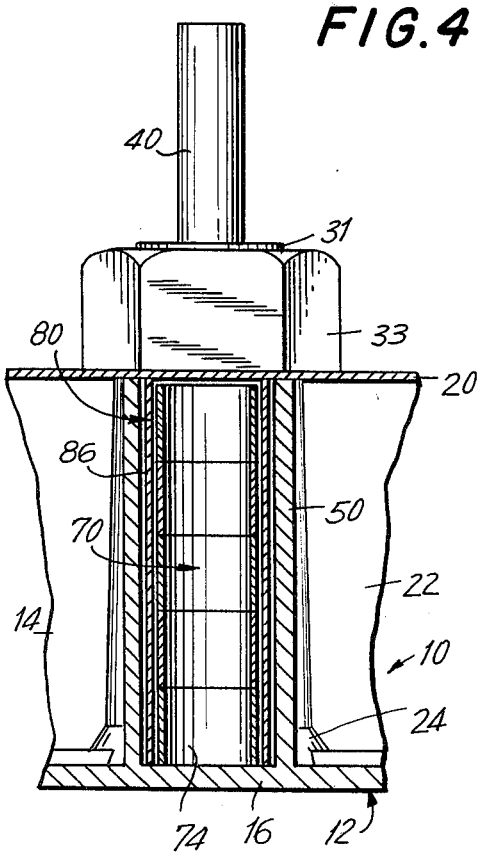
FIG. 4 is a fragmentary axial sectional view taken on line 4—4 of FIG. 1.

A shaft or bolt 28 has a cylindrical shank 29 extending through sleeve 22 and hole 21 in plate 20. The bolt has a left-hand threaded portion 31 at the end of the shank. The bolt has a conical head formed with opposed parallel chordal flat lands or faces 32 which abut lands 26 in the outer end of sleeve portion 24. Sleeve portion 24 can be formed with only one land 26 if desired, in which construction, sleeve 22 must have a thickened wall opposite from one land 26 to balance the hub in rotation. A hexagonal nut 33 engages on the threaded end 31 of shank 29 and bears against plate 20. An integral shaft 40 of reduced diameter extends axially from the threaded end of shank 29. This shaft projects axially outwardly of the hub for mounting the rotary scraper in a chuck of a drill (not shown) or other driving motor means. On the outside end of wall 16 is an arrow 34 and legend 36 indicating the proper direction of rotation of the rotary scraper during use. FIGS. 1 and 4 show shaft 40 extending axially from shank 29.

The outer wall of hub 12 is generally serpentine in configuration. It is formed with integral reentrant flat parallel walls 44 and 46 expanded at their inner ends to form cylindrically curved internal wall sections defining circumferentially spaced axial sleeves 50 integral with and closed at end wall 16; see FIGS. 1, 2 and 4. Opposite ends of the sleeves are open. The hub has six cylindrical sleeves 50 spaced equally apart inside the hub and circumferentially thereof. Each flat wall 44 leading in the direction of rotation of the hub indicated by arrow A in FIG. 1 is about twice as long as trailing wall 46. The flat walls 44, 46 are spaced apart and define narrow flat channels 54 disposed chordally in the hub and communicating with the axially disposed cylindrical recesses defined by sleeves 50. Each sleeve 50 is tangential to the plane of leading flat wall 44. Each flat wall 44 in direction of rotation A of hub 12 has a width about twice that of wall 46 taken chordally of the hub in the plane of channel 54. The disposition of each channel 54 is such that each channel subtends an arcuate angle B of about 90° if extended by plane P to intersect wall 14; see FIG. 1. This plane P may subtend an angle ranging from 45° to 120° so fingers 70 point in proper chordal directions for treating a work surface.

Each wall 44 defines a wedge 60 with outer curved wall 14. The walls of the wedge define an angle of about 30°. The apical end 62 of the wedge extends the full length of the wedge axially of the hub, and has a radius of curvature of at least 1/16 of an inch. The narrow end 62 of each wedge curcumferentially of the hub is directed opposite to direction A of rotation of the hub. Each flat wall 46 at its outer end merges into a curved wall section 64 which is convex and has a radius of curvature of not less than ¼ of an inch. The curved wall sections 64 are located at the trailing sides of channels 54, while the blunt or rounded apices 62 of wedges 60 are located at the leading sides of channels 54 in the direction A of rotation of the hub. Each wall 46 terminates at its inner end in a corner 46′ where the wall joins sleeve 50.

Figure 2:
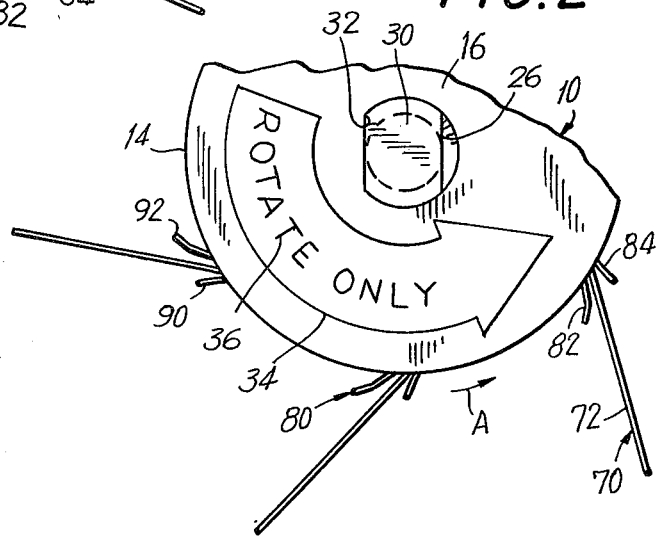
FIG. 2 is a fragmentary opposite end view of the rotary scraper of FIG. 1.
Figure 3:
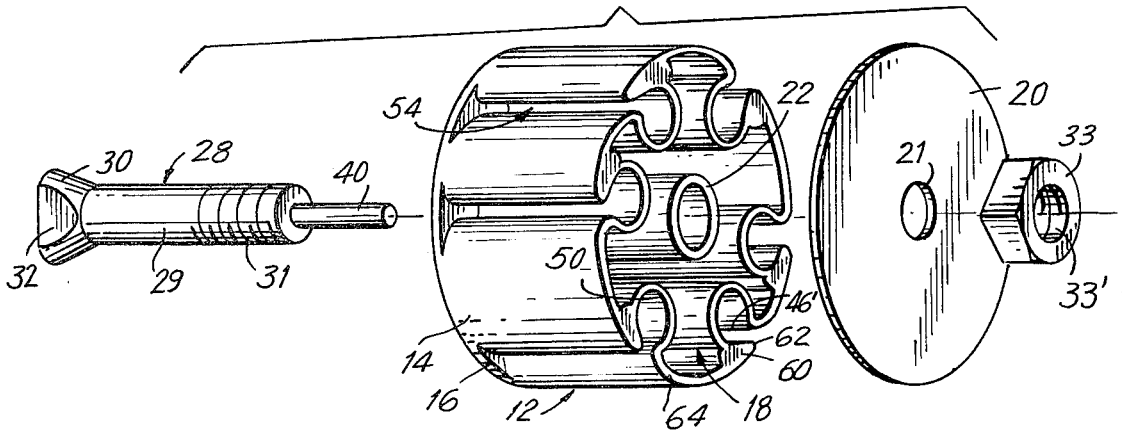
FIG. 3 is an exploded perspective view of parts of the rotary scraper of FIGS. 1 and 2, the springy fingers and spring clips being omitted.

Springy fingers 70 have flat shafts 72 which are normally disposed in side-by-side array in channels 54 axially of hub 12; see FIGS. 1, 2 and 4. The thickness of each shaft 72 is less than the width of each channel 54 in a circumferential direction in the hub. Each finger 70 terminates in a cylindrically curved knuckle 74 whose diameter is less than the internal diameter of each sleeve 50. Each knuckle is tangential to the plane of flat side 97 of each shank 72.

Figure 5:
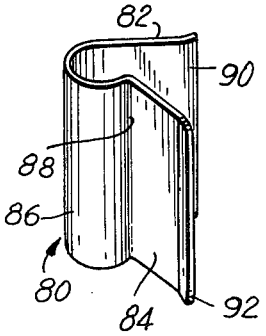
FIG. 5 is a perspective view of a spring clip such as used in the rotary scraper of FIGS. 1 and 2.
Figure 6:
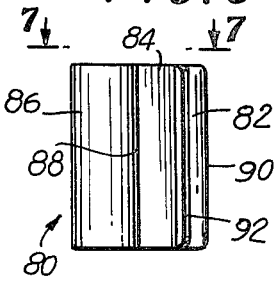
FIG. 6 is a side elevational view of the spring clip of FIG. 5.
Figure 7:
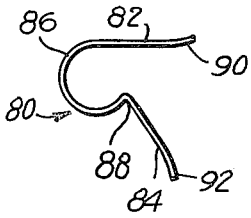
FIG. 7 is an end view of the spring clip taken on line 6—6 of FIG. 5.

A spring clip 80 is provided for each sleeve 50. This clip as best shown in FIGS. 1, 4–7, has a general U-shape with flaring, opposing, flat side walls 82, 84 integral with a cylindrically curved apical bight or loop 86. Bight 86 is tangential to wall 82. When the clip is compressed, bight 86 fits axially into a sleeve 50 while side walls 82, 84 extend in parallel spaced disposition through channel 54 juxtaposed or abutting walls 44, 46 respectively; see FIG. 1. Bight 86 surrounds knuckles 74 of the array of abutted spring fingers inside the clip. A rather sharp bend 88 is formed at the inner end of wall 84 where it joins bight 86 to engage 46′ at the inner end of channel wall 46. Outer end 90 of wall 82 is curved slightly outwardly away from channel 54 in the leading direction of rotation A, and outer end 92 of wall 84 is curved and bent slightly outwardly from channel 54 in the trailing direction opposite to direction A. FIGS. 5, 6 and 7 show clip 80 in expanded position. FIGS. 1 and 4 show clips 80 in compressed position and tensioned in sleeves 50.

Each springy finger 70 is angularly rotatable slightly (about 5°) without flexing in chordal channel 54 between spaced opposite sides 82, 84 of a spring clip 80. The thin springy fingers can be freely inserted into and removed from the hub without disturbing the spring clips which are held snugly in sleeves 50 and channels 54. Shanks 72 of the springy fingers are thinner than the spacing between sides 82, 84 of the spring clips when they are in compressed position in hub 12. The external diameters of tangential knuckles 74 of the springy fingers are smaller than the internal diameters of tensioned, compressed bights 86. The tangential knuckles thus slide easily axially into tangential bights 86 of the clips.

While the assembled rotary scraper 10 is being used to treat a work surface, the springy shanks 72 flex in turn in the trailing direction. When the fingers are in contact with the work surface each shank 72 will contact trailing springy side wall 84 of its retaining spring clip 80. At the point of extreme bending, the curved end 92 of clip side 84 will be contacted. This will spread the work force or bending pressure over a longer radius than was possible with the rotary scraper not provided with spring clips 80, and in which the springy fingers directly contacted the unyielding walls of channels 54. When the springy fingers are released from the work surface as the device rotates, the springy shanks 72 will flex forwardly in the direction of rotation A to contact leading springy side walls 82 of the clips 80. At the extremes of flexing the springy shanks 72 will bear against extended curved ends 90 of clip sides 82. This will spread the reactive bending forces over a longer radius than would be possible if the clips 80 were not present. The springy shanks 72 cannot directly contact the wedge elements 60 or the short curved wall sections 64 of hub wall 14. The useful lives of the springy fingers are extended since metal fatigue and breakage of the springy shanks against the unyielding external parts of channels 54 are prevented.

Bolt 28 can be inserted through sleeve 22 in only one direction so that shaft 40 projects out of the hub body at the side opposite closed end wall 16. Head 30 cannot be fitted in or through hole 21 in plate 20. By this arrangement it is assured that the hub and springy fingers will only rotate in the proper clockwise direction A as viewed in FIG. 1. Rotation of device 10 in the direction opposite to direction A would break the fingers and damage the work to be treated, so the axial positioning of the bolt 28 is arranged to prevent improper rotation of the device. Head 30 of the bolt is keyed to lands 26 in sleeve end 24. This feature assures that the hub cannot rotate with respect to the shaft, and both must rotate with the motor driven chuck holding shaft extension 40 and driving the device in direction A.

Nut 33 has left-hand or reverse threading 33′ which tightens the nut when screwed on left-hand or reverse thread 31 of bolt 28, i.e. counterclockwise direction as viewed in FIG. 1. Thus the nut tends to tighten when the device is used and rotated in direction A. To loosen the nut for disassembly of the device, the nut will be turned clockwise in direction A as viewed in FIG. 1, with respect to hub body 12, while the hub is held stationary.

Figure 8:
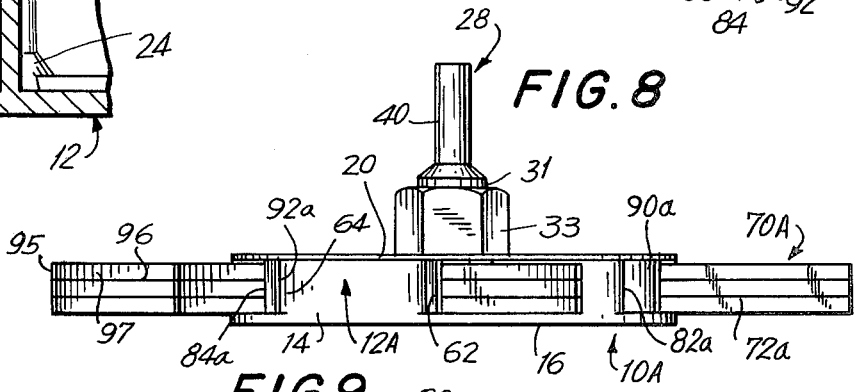
FIG. 8 is a side elevational view of another assembled rotary scraper embodying a modification of the invention.
Figure 11:
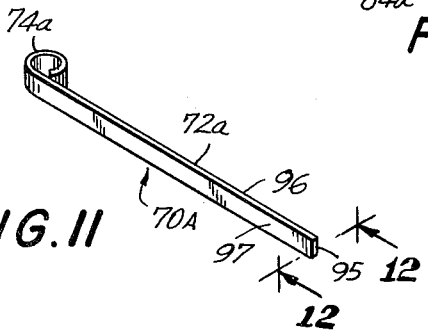
FIG. 11 is a perspective view of a springy finger used in the rotary scraper of FIG. 8.
Figure 12:
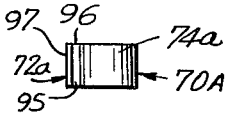
FIG. 12 is an enlarged end view taken on line 12—12 of FIG. 11.

FIG. 8 shows a modification of the invention. Here rotary scraper 10A has a hub body 12A which is axially short as compared with hub 12. The hub can be one-half inch or less in axial length. This construction is provided for use in scraping narrow joints such as welds, and for scraping in tight corners. Here only three narrow springy fingers 70A are provided, although more or less can be used. As best shown in FIGS. 11 and 12, each narrow springy shank 72*a* may be rectangular in cross section with a flat end 95. Each shank terminates at its other end in a cylindrical knuckle 74*a* which is tangential to the shank for disposition inside a spring clip 80A.

Figure 9:
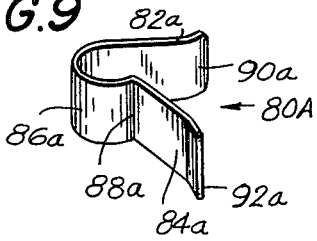
FIG. 9 is a perspective view of a spring clip used in the rotary scraper of FIG. 8.
Figure 10:
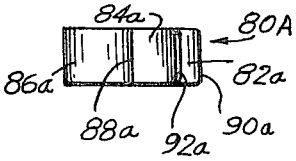
FIG. 10 is a side elevational view of the spring clip of FIG. 9.

Spring clip 80A as best shown in FIGS. 9 and 10 is axially short to fit snugly inside hub body 12A. The width of the spring clip is equal to the width of the array of springy fingers 70A which it retains. Each springy clip has a cylindrical bight 86*a* with integral leading side wall 82*a* having a bent end 90*a* and a trailing side wall 84*a* with outer bent end 92*a*. Both bent ends 90*a* and 92*a* flare outwardly away from each other. Side wall 84*a* terminates at inside sharp bend 88′ similar to the structure of clip 80 described above. The springy shanks 72*a* fit loosely between compressed side walls 82*a*, 84*a* in the same way as shown in FIG. 1, to permit slight angular rotation in clips 80A during operation of the device 10A. The axially short scraper 10A is especially adapted for dressing narrow welds and seams without scraping adjacent surfaces.

Figure 13:
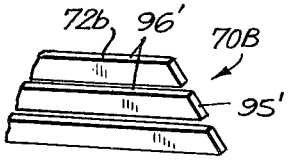
FIG. 13 is an enlarged perspective view of part of an array of springy fingers embodying a modification of the invention.

The free end 95 of each shank 72*a* is perpendicular to the top and lateral sides 96, 97 of shank 72*a*. The plane of ends 95 of the springy fingers is flat and perpendicular to the top, bottom and side surfaces of the springy shanks. FIG. 13 shows another construction. Here there is a chisel shaped, pointed array of springy fingers 70B. Free ends 95′ of the shanks 72*b* are coplanar and disposed at an angle to upper and lower sides 96′ of the springy shanks. This angular array enables the chisel shaped rotary fingers to work up to the apex or fillet of a corner to be scraped.

Figure 14:
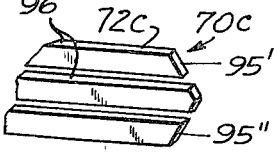
FIG. 14 is a view similar to FIG. 13 showing part of another array of springy fingers embodying a further modification of the invention.

FIG. 14 shows another chisel shaped array of springy fingers 70C. Here the planes of free ends 95′, 95″ of springy shanks 72*c* are disposed at an angle to top and bottom sides 96″ and define an apical angle which enables the springy fingers to fit into a narrow V-shaped corner to be scraped. When fingers 70B or 70C are used in hub body 12A the planes of the shisel shaped shank ends will be disposed at angles to the axis of the hub. All the fingers 70A, 70B or 70C can be used interchangeably in scraper devices 10 and 10A.

The rotary devices described above can be used for treating any desired shape and type of work surface, including flat and curved surfaces, irregular surfaces, narrow welds and seams, tight corners, narrow crevices, etc., without requiring manual filing and finishing. The light weight hub structure can be mounted on a conventional hand drill. All surface treating elements, the spring clips and all other parts can be made of suitable metals or other materials by known methods. All parts of the rotary scrapers are quickly installed, replaced and interchanged with others. Variations from the embodiments described may occur to those skilled in the art without departing from the invention as defined in the following claims, and the claims are intended to cover all such variations.

What is claimed is:

1. A rotary scraper device for treating a work surface, comprising:

a generally cylindrical hollow hub casing having a peripheral wall and central axis, and adapted for rotation in one direction about said axis, said hub casing having a closed end wall and an open opposite end;

a cover plate removably mounted on said open end of said hub casing;

a shaft extending axially outward of said cover plate for engagement by rotary motor means;

spaced walls inside said hub defining a plurality of channels chordally disposed in said hub casing and opening at said peripheral wall to receive respectively springy side walls of generally U-shaped spring clips and to receive springy fingers in axial coplanar array within each of said clips; and a plurality of circumferentially spaced, axially disposed sleeves in said hub casing communicating laterally and tangentially with said channels respectively to receive bights at inner ends of said clips and to receive knuckles at inner ends of said fingers axially disposed inside said bights.

2. A rotary scraper device as defined in claim 1, wherein said hub casing has an axial length of not more than one half inch for scraping narrow welds and seams on a surface without touching adjacent portions of said surface.

3. A rotary scraper device as defined in claim 1, further comprising a plurality of generally U-shaped spring clips each having laterally spaced springy side walls integral at one end with a generally cylindrical bight disposed tangentially to one of said side walls, each of said bights fitting snugly axially in one of said sleeves to receive said knuckles of said fingers while said spaced side walls of said clips receive springy shanks of said fingers.

4. A rotary scraper device as defined in claim 3, wherein each of said clips has a width axially of said hub casing substantially equal to the width of each of said channels axially of said hub casing, to prevent free axial movement of said clips inside said hub between said closed end wall and said cover plate.

5. A rotary scraper device as defined in claim 3, wherein said side walls of each of said clips abuts in spring tension opposing spaced walls of one of said channels in said hub casing, with free ends of said side walls of said clips extending outwardly of said channels at said peripheral wall to support said springy shanks of said fingers when flexed.

6. A rotary scraper device as defined in claim 5, further comprising springy fingers each having a straight springy shank and an integral knuckle at one end, each knuckle being turnably disposed in one of said bights of one of said clips, each springy shank being turnably disposed between spaced side walls of a clip and extending outwardly of said hub casing and beyond outer ends of said side walls of said clip chordally to said hub casing to contact a work surface, each of said knuckles being disposed tangentially to the springy shank of a finger to fit into a tangentially disposed bight of a clip.

7. A rotary scraper device as defined in claim 6, wherein each of said springy side walls of said clips has outwardly bent oppositely flared marginal edges to support end portions of said springy shanks when fully flexed in both leading and trailing directions while said hub casing rotates in said one direction.

8. A rotary scraper device as defined in claim 6, wherein said shanks of said fingers are disposed in coplanar array in each of said channels axially of said hub casing.

9. A rotary scraper device as defined in claim 8, wherein outer ends of said springy shanks are disposed in at least one plane angular to the axis of said hub casing to enter narrow corners and crevices for scraping closely spaced surfaces thereof.

10. A rotary scraper device as defined in claim 8, wherein said hub casing has an axial length of not more than one half inch so that said springy fingers can scrape narrow welds on a surface without touching adjacent portions of said surfaces, and can enter narrow corners crevices for scraping closely spaced surfaces.

11. A rotary scraper device for treating a work surface, comprising:

a generally cylindrical hollow hub casing having a serpentine peripheral wall and a central axis, and adapted for rotation in one direction about said axis, said hub casing having a closed end wall and an open opposite end;

a cover plate removably mounted on said open end of said casing, and having a central opening;

a shaft in said casing extending axially thereof outward of said cover plate through said central opening for engagement by rotary driving motor means;

spaced walls inside said casing defining a plurality of channels chordally disposed in said casing and opening at said peripheral wall to receive springy fingers in coplanar array within each of said channels;

a plurality of circumferentially spaced, axially disposed sleeves in said casing communicating laterally and tangentially with said channels respectively to receive knuckles at inner ends of said fingers, said spaced walls merging smoothly with said peripheral wall at outer ends of said channels to define first and second rounded bearing surfaces for said springy fingers, said first rounded bearing surfaces supporting said fingers when they are applied to said work surface and flexed while said casing is rotated in said one direction, said second rounded bearing surfaces defining wedge shaped abutments with said peripheral wall for supporing said fingers when they flex free from said work surface while said casing is rotated in said one direction.

12. A rotary scraper device as defined in claim 11, further comprising springy fingers each having a straight springy shank tangential to an integral cylindrical knuckle at one end of each finger, each knuckle being turnably disposed between side walls of one of said channels and extending outwardly of said casing beyond said bearing surfaces for treating said work surface, each of said fingers being freely removable from said casing when said cover plate is removed.

* * * * *